United States Patent [19]

Tamura et al.

[11] 4,233,108

[45] Nov. 11, 1980

[54] PROCESS FOR USE IN ETCHING THE OUTER SURFACE OF A METAL MEMBER

[75] Inventors: Masamitu Tamura; Yukio Yasuhara; Shigeharu Nakamura; Masaru Sakai; Kazuo Akagi; Ryohei Kazihata; Norio Satohara, all of Shimonoseki, Japan

[73] Assignee: Kobe Steel, Limited, Kobe, Japan

[21] Appl. No.: 17,374

[22] Filed: Mar. 5, 1979

Related U.S. Application Data

[63] Continuation of Ser. No. 825,469, Aug. 17, 1977, abandoned, which is a continuation of Ser. No. 620,231, Oct. 6, 1975, abandoned.

[30] Foreign Application Priority Data

Oct. 5, 1974 [JP] Japan ..... 49-114872

[51] Int. Cl.[2] ..... C23F 1/00

[52] U.S. Cl. ..... 156/639; 156/345; 156/642; 156/664

[58] Field of Search ..... 156/637, 639, 642, 664–666, 156/345; 134/3, 10, 23, 32, 34, 41, 122 R

[56] References Cited

U.S. PATENT DOCUMENTS

| | | | |
|---|---|---|---|
| 1,393,633 | 10/1921 | Moltrup | 134/41 X |
| 3,329,542 | 7/1967 | Stiehl | 156/642 X |
| 3,620,813 | 11/1971 | Minbiole et al. | 134/32 X |
| 3,751,344 | 8/1973 | Angelini | 204/28 |
| 3,806,366 | 4/1974 | Cofer et al. | 134/3 |
| 3,900,376 | 8/1975 | Copsey et al. | 204/141.5 |

*Primary Examiner*—William A. Powell

*Attorney, Agent, or Firm*—Oblon, Fisher, Spivak, McClelland & Maier

[57] ABSTRACT

A process and an apparatus within which there is provided at least one, or a plurality of tanks in series relation, depending upon the type of member being treated, each tank having one or more openings within its walls, respectively, which are provided in alignment with each other. With this apparatus, one or more metal members such as for example, a bar, rod, pipe, or tube, is rotatably fed through the aforenoted openings into the tank or tanks, thereby enabling a continuous automatic-etching process of the outer surface of the metal members to be performed. As an alternative, there is provided within each tank, a triple walled cylindrical body or solution flow guide, whereby a solution for etching may uniformly flow in the direction of the metal member being conducted through the tank or tanks, and along the outer surface thereof, so that a desired surface condition of the bar, rod, pipe or tube may be obtained in an efficient manner.

6 Claims, 13 Drawing Figures

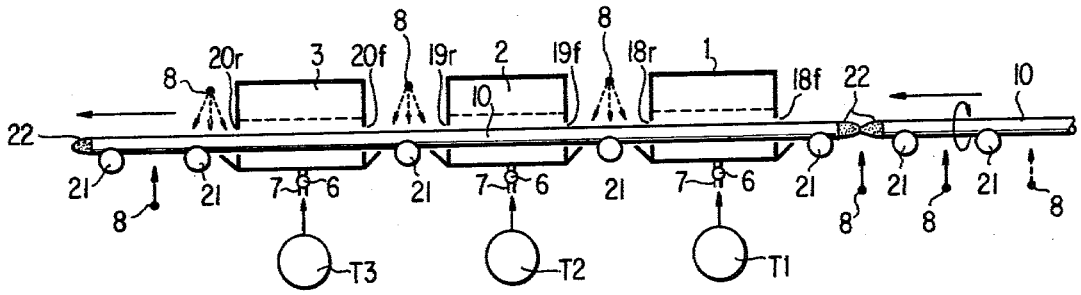
FIG.2
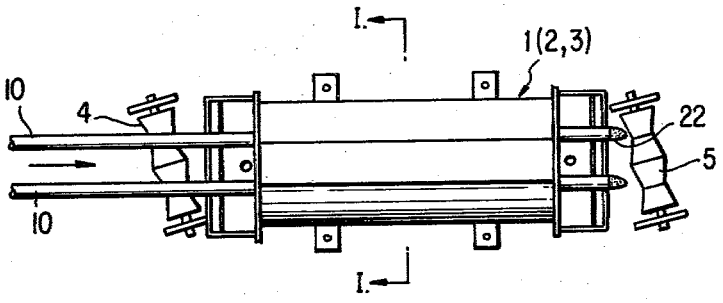
FIG.5a
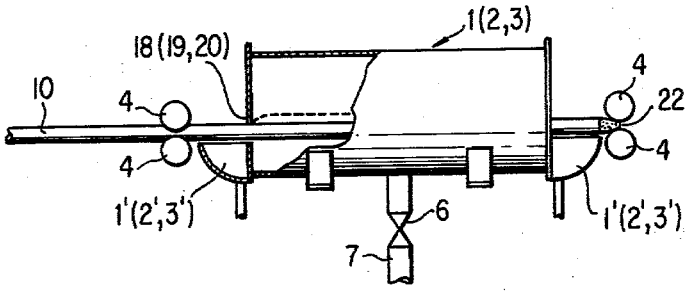
FIG.5b
FIG.6
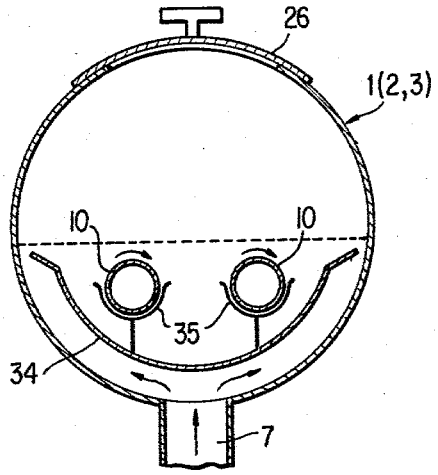

PROCESS FOR USE IN ETCHING THE OUTER SURFACE OF A METAL MEMBER

This is a continuation, of application Ser. No. 825,469, filed Aug. 17, 1977, which is a continuation of Ser. No. 620,231, filed Oct. 6, 1975, both now abandoned.

BACKGROUND OF THE INVENTION

1. Field of the Invention

The present invention relates generally to a process and an apparatus for use in etching the outer surface of a metal member, such as for example, a bar, rod, pipe or tube made of, for example, zirconium or zirconium alloy, and more particularly to a process and an apparatus which facilitates the automatic etching of a metal member, such as, for example, a bar, rod, pipe or tube with improvements in the resulting surface condition.

2. Description of the Prior Art

Heretofore, an etching treatment has been widely used for a metal member, such as, for example, a bar, rod, pipe, or tube in an attempt to remove defects within or upon the surface of the metal member and to obtain a desired surface condition by etching the outer surface of the metal member with acid solutions, followed by neutralization and water rinsing. Typified by those attempts is a dipping etching process which employs a plurality of tanks, however, such a process poses many shortcomings in that even in the case that a plurality of stainless steel rods or pipes are simultaneously dipped within a tank at the same time, there is required many man-hours for performing the operations of processing such pipes or rods from one tank to another, and that in the case of etching special type metal rods or pipes, such rods or pipes should be dipped individually. This is particularly true with the case of metal members, such as, for example, a rod, pipe or tube, made of, for example, zirconium or zirconium alloy, or titanium or titanium alloy.

The aforenoted special-type metal members, which require a smooth surface condition, such as for example, those members made of zirconium or zirconium alloy, must be subjected to polishing after the final annealing heat treatment, and then to etching of its outer surface with an acid solution, such as, for example, a nitric acid solution, hydrofluoric acid solution, or the like, in order to obtain a desired mirror-finish surface for the final product. In this case, however, the portion of the metal pipe which remains idle or non-movable within the etching acid solution, develops pits, acid stains, gouges, or other non-uniform areas upon its resulting surface. In addition, the metal pipe must be placed within a neutralizing liquid immediately subsequent to the etching operation, within which, if the dipping time of the metal pipe is excessively long, there then results non-uniform surface areas. From this viewpoint, etching of a plurality of pipes at the same time is virtually impossible.

Furthermore, in the instance that the pipes should be subjected to an etching process utilizing two types of acids, such as, for example, a concentrated acid and a weak acid, the duration of the dipping periods, for example, are specified as follows: weak acid (90 seconds)→concentrated acid (30 seconds)→neutralization (10 seconds)→water rinsing, and such steps should be carried out continuously. Even in the instance of using a medium type or strength acid, steps similar to those noted heretofore should be followed. In the event of a deviation or discrepancy within the aforenoted steps, there results white corrosions upon the surface of the pipe during the final autoclave step. Still further, as the metal pipes have to be finished as closely as possible to ordered specifications in order to satisfy tests which will be performed by the consumer upon delivery, the metal pipes should be dipped within the acid solutions in an individual manner in order to insure obtaining or satisfying the strict requirements for quality.

The prior art etching process for a metal pipe, made of, for example, zirconium or zirconium alloy and required to have a smooth surface condition, will now be described, the same including a two-stage etching process utilizing concentrated and weak acids. According to such prior art etching processes, as shown for example, within FIG. 1, a weak acid tank 12, a concentrated acid tank 13, a neutralizing tank 14, and a water-rinsing tank 15 are serially arranged in a side-by-side fashion. Initially, a single metal pipe 11 is mounted within balance jigs 16, and subsequently, the balance jigs and pipe are disposed within the weak acid tank 12 by means of two operators a and b in accordance with a signal delivered from an operator e who monitors the dipping time. Within this process, the pipe is rotated slowly within the tank for approximately 90 seconds, and subsequently, in response to another signal of the operator e, the acid solution is discharged from the interior of the pipe by means of the two operators a and b.

The pipe is then placed, by means of operators c and d, within the concentrated acid tank 13 for a time period of several seconds, after which the pipe is rotated within the concentrated acid solution for a time period of approximately 30 seconds. Upon completion of this step, the pipe is disposed within the neutralizing tank 14, by means of operators a and b, without interruption, that is, without any substantial time lapse and with the acid solution retained within the pipe, for performance of a neutralizing treatment of approximately 10 seconds. The pipe is thereafter placed within a water rinsing tank 15 for performance of a water rinsing operation, the balance jigs 16 being removed at this time, the same being disposed upon a spacer support 17.

Accordingly, it is apparent that at least five operators a, b c, d and e are required for performance of the etching process of the inner and outer surfaces of the metal pipe 11, thus presenting unsatisfactory operational efficiency, the operators being relegated to merely manual operations. Another shortcoming with the aforenoted process is that a large quantity of acid and neutralizing liquid is required, and a noticeable deterioration of the liquids also results. In addition, the use of nitric acid, hydrofluoric acid, or the like presents safety problems with respect to the operators due to a generated acid vapor atmosphere and the risk of splashing of the acids onto the operators.

It appears that the primary factor which is responsible for the aforenoted discrepancies is a non-uniform and low flow rate or velocity of the acid solution relative to the surface of the metal pipe which contacts the solution. This type of an etching process also suffers from the aforenoted safety problems as well as difficulties enabling the continuous operation of the process, and accordingly, there arises a demand for improvements in the operational efficiency of etching processes for the outer surfaces of a metal member, such as for example a rod, pipe, or tube by automating the respective steps of the etching process.

SUMMARY OF THE INVENTION

Accodingly it is a principal object of the present invention to provide a process and an apparatus for use in etching the outer surface of a metal member, such as, for example, a rod, pipe or tube, within which the series of steps of etching, neutralization, and water-rinsing are carried out in a continuous and automated manner at a high rate of efficiency.

According to the present invention, there is provided a process and an apparatus for use in etching the outer surface of a metal member, such as, for example, a rod, pipe, or tube, within which there is provided at least one or a plurality of tanks containing one or more treating solutions or liquids respectively, each of which has one or more openings within its walls, and arranged in such a manner that the openings are disposed in alignment with each other. Thus, a metal member is able to be rotatably fed through such openings so as to continuously pass through the aforenoted tank or tanks, in a serial manner.

In this respect, in order to achieve a further effective etching treatment, it is desirable that the flow velocity of the treating solution relative to the surface of the metal pipe be increased and the direction of flow of the solution be the same as that of the metal pipe being conducted or conveyed. More preferably, the treating solution is deposited and maintained within the tank to a level which covers the entire surface of the metal pipe, while the solution overflowing the same through means of the aforenoted openings may be recovered so as to be returned and recycled back into the aforenoted tank. Still further, the treating solution adhering to the surface of the metal pipe should preferably be washed off between adjoining tanks.

According to another aspect of the present invention for achieving the aforenoted efficient etching process, there is provided an apparatus, within which there is provided at least one or a plurality of tanks each containing a treating solution and one or more openings within its walls, and feedings means adapted to introduce a rotating metal pipe through the aforenoted openings and through the tank or tanks.

According to a further aspect of the present invention, there is provided an apparatus for achieving a further improved etching treatment process, within which there is provided within each of the tanks a triple-walled cylindrical body consisting of an inner cylinder, an intermediate cylinder, and an outer cylinder, and having a solution feed inlet defined within the outer cylinder, and communicating holes defined within the wall of the intermediate cylinder for introducing the treating solution therethrough and into the inner cylinder which houses the metal pipe to be treated therein, whereby the treating solution may flow in the direction of travel of the aforenoted metal pipe. Preferably, still further, the inside diameter of the inner cylinder is at most 1.4 times as large as the outside diameter of aforenoted metal pipe so as to allow the solution to flow in the direction of travel of the pipe.

In this respect, there is additionally provided, below respective openings within the tanks, solution-receiving means which receive the solutions as the same overflow through the interstices defined between the openings and the pipe, whereby the solutions are able to be returned to the corresponding tank, with the aid of suitable re-cycling means which is operatively connected to the aforenoted solution receiving means. Preferably, the re-cycling means should be provided with flow-rate regulating valves, and still further, the length of the respective tank should be governed by the factor of the desired dipping time and the travel rate or speed of the metal pipe so as to maintain constant the travel speed of the metal pipe through the tanks.

Still yet further, each tank should have at least one through-hole or opening within its walls, and such openings should be arranged in alignment with each other. In addition, flow-resistance-reducing columnar caps or plugs should be fitted within the ends of the metal pipe to be treated for the purpose of preventing an ingress of the treating liquid into the interior portion of the metal pipe as well as preventing a tapering or etching of the open ends of the metal pipe by means of the treating solution. In this manner, the aforenoted plug has a rear portion which is adapted to be fitted within the metal pipe, an intermediate portion whose outside diameter is equal to that of the metal pipe being treated, and a tapered head portion adapted to reduce the flow resistance thereto.

Accordingly, the process and apparatus developed in accordance with the present invention facilitates the etching of the outer surface of a metal member, such as, for example, a rod, bar, pipe, or tube, with the treating solution flowing at a uniform and increased velocity, and which enables the continuous steps of the etching process to be performed, thereby preventing local errosion and pits upon the surface of the metal member.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views and wherein:

FIG. 2 is a schematic view illustrative of an etching operation developed in accordance with the present invention;

FIGS. 5*a* and 5*b* are plan and side views, respectively, showing an etching treatment tank of the present invention;

FIG. 6 is an enlarged cross-sectional view of the tank of FIG. 5*a* taken along the line I—I of FIG. 5*a;*

DETAILED DESCRIPTION OF THE ILLUSTRATED EMBODIMENTS

Figure 1:
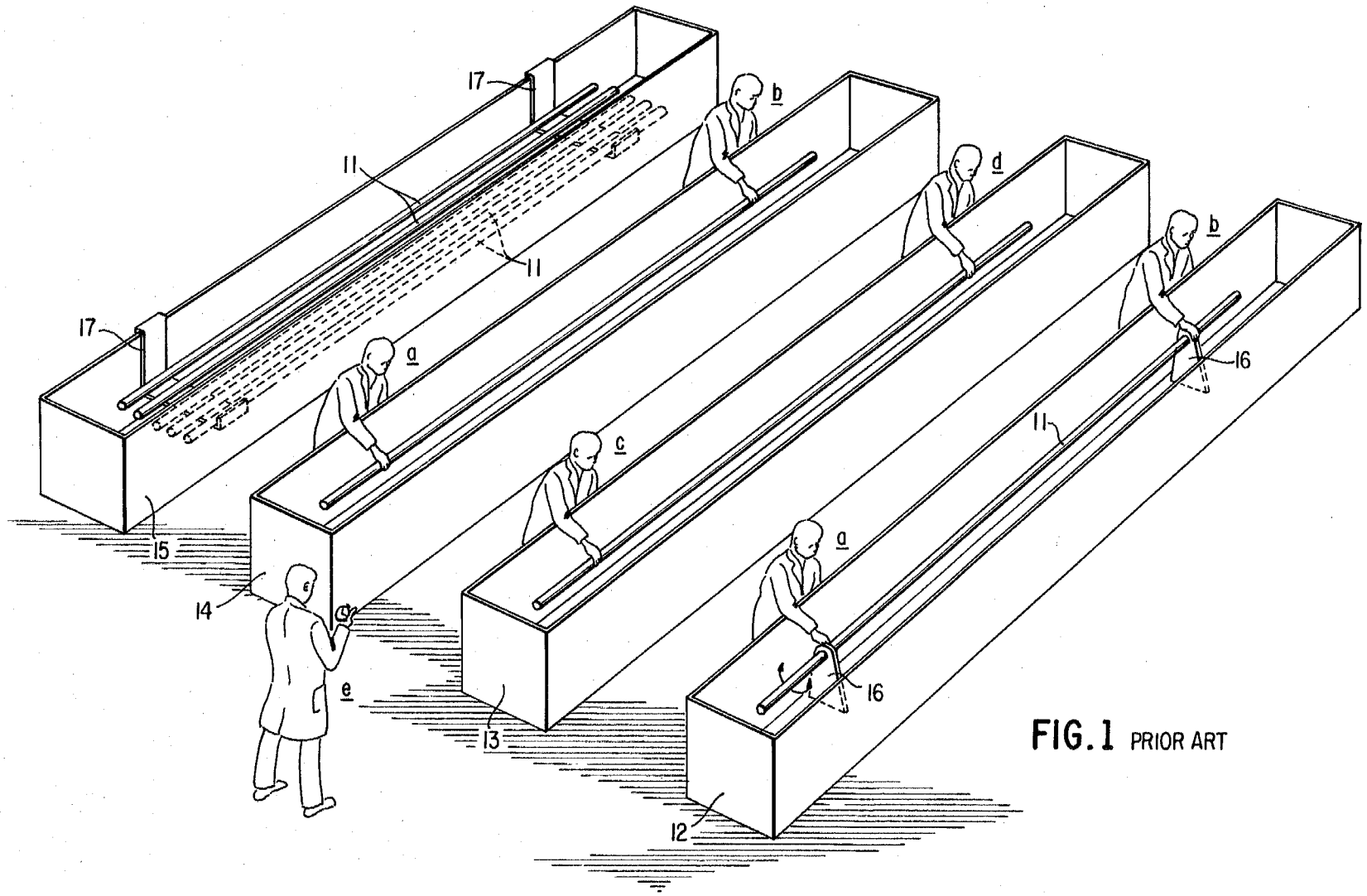
FIG. 1 PRIOR ART
FIG. 1 is a perspective view illustrative of an etching operation for the inner and outer surfaces of a metal pipe, made of, for example, zirconium or a zirconium alloy, in accordance with the prior art.

For convenience of the detailed description of the present invention, the description will be specifically directed with respect to the etching of a metal pipe, made of for example, zirconium or a zirconium alloy which is required to have smooth surface conditions, within which etching, utilizing weak and concentrated acids, a neutralizing treatment, and water rinsing are carried out sequentially. With the zirconium or zirconium alloy pipe or tube, nitric acid, hydrofluoric acid, or the like are utilized for etching the outer surface of the pipe. Heretofore, the zirconium or zirconium alloy pipe is initially dipped within a weak acid solution so as to adjust or prepare the condition of the surface of the pipe, and subsequently, the pipe is dipped within a concentrated acid solution for etching or reducing the outside diameter of the pipe to a desired characteristic or value. The pipe is dipped within a neutralizing liquid so as to thereby prevent acid-errosion of the same, after which the pipe is subjected to water rinsing thereby completing the etching process.

In contrast thereto, in accordance with the present invention, as shown within FIG. 2, there is provided in a serial fashion, a weak acid tank 1 containing a weak acid solution of a desired amount, a concentrated acid tank 2 containing a concentrated acid solution of a desired amount, and a neutralizing tank 3 containing a neutralizing solution of a desired amount, the aforenoted tanks 1, 2, and 3 being arranged in this order. A pipe 10 is rotatably conducted or conveyed through the respective tanks 1, 2, and 3 whereby the steps of etching, neutralization, and water rinsing are continuously carried out.

In this respect, the respective tanks 1, 2, and 3 are respectively provided with through-holes or openings 18*f*, 18*r*, 19*f*, 19*r*, 20*f* and 20*r* within the front and rear walls thereof for permitting passage of the pipe 10 therethrough, the aforenoted holes or openings being arranged in alignment with each other. In order to rotatably feed or convey the pipe 10 through the respective openings, as well as for rotation of the pipe about its axis and the linear movement thereof, there is also provided rotatable feeding means, such as for example, scrolls or rollers 21 disposed in front of and rearwardly of the tanks, or in other words, between adjoining tanks, whereby the pipe is rotatably conveyed through the tanks for performance of the continuous sequential steps of the etching process which utilizes the weak acid treatment for a time period of approximately 90 seconds within the weak acid tank 1, a concentrated acid treatment for a time period of approximately 30 seconds within the concentrated acid tank 2, and a neutralizing treatment for a period of time approximately 10 seconds within the neutralizing tank 3, after which water rinsing is performed.

Plugs 22 are fitted within the open ends of the pipe 10 so as to prevent the ingress of the treating solution therein, although such means is obviously not required for a solid metal rod or bar. Water-rinsing showers 8 are provided at required positions in such a manner as to face the outer surface of the pipe 10 at positions immediately downstream of the respective tanks so as to thereby remove treating-solution or rinsing water which may adhere to the surface of the pipe. The solutions required for the respective tanks 1, 2, and 3 are supplied from solution reservoirs T1, T2, and T3, by means of solution feed pipes 7 having flow-rate regulating valves 6 disposed therein, and under the influence of suitable pumps, not shown. In this respect, the feeding or conveying speed of the pipe 10 is governed by means of the dipping time of the pipe within tank 2, while the dipping time within the concentrated acid tank 2 is in turn governed by means of the reduction percentage of the outside diameter of the pipe after the treatment.

Figure 3:
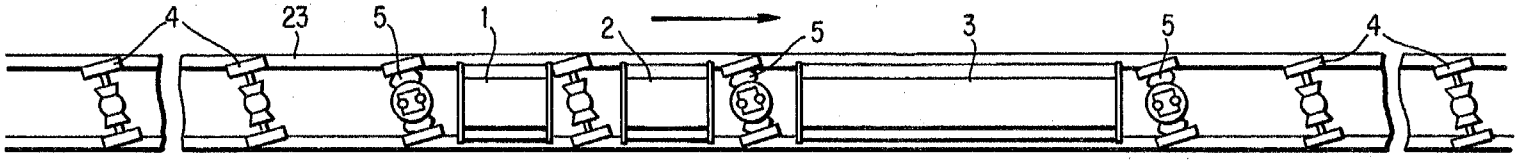
FIG. 3 is a plan view of an apparatus constructed in accordance with the present invention and showing its cooperative parts.
Figure 4:
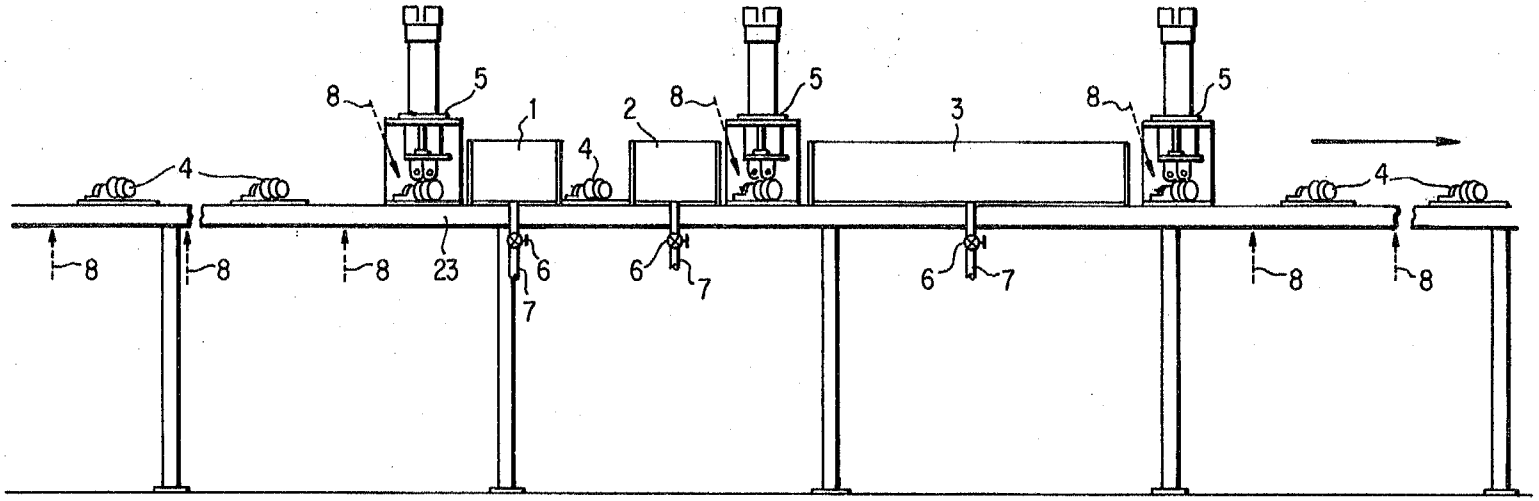
FIG. 4 is a side view of the apparatus of FIG. 3.

More particularly, with reference being made to FIG. 3, which shows the schematic outline of the operations of the etching process in accordance with the present invention, assuming that the dipping time within the concentrated acid within the concentrated acid tank 2 is set to be approximately 30 seconds, which is dependent upon the reduction percentage in the outside diameter of the pipe after the concentrated acid treatment, then the pipe should pass through the tank 2 within a period approximating 30 seconds, and thus, the feeding or conveying speed of the pipe 10 by means of the scrolls 21 is determined so as to appropriately accommodate or accomplish such feeding speed of the pipe 10.

Pipe 10, having its opposite open ends closed by means of the plugs 22, is then disposed upon the first several or leading rollers or scrolls 21 so as to be rotatably conveyed into the first weak acid tank 1. A weak acid solution is previously supplied into the weak acid tank 1, and thus, the surface condition of the pipe is pre-adjusted or prepared during its travel therethrough, followed by water rinsing, by means of the water-rinsing shower 8, immediately after its passage through the weak acid tank 1. The pipe then enters into the second concentrated acid tank 2, wherein the outside diameter of the pipe 10 is reduced a desired amount as a result of the concentrated acid solution supplied therein, and subsequent thereto, the pipe 10 is again subjected to water rinsing by means of a water-rinsing shower so as to remove the concentrated acid adhering to its surface.

Following its second rinsing or shower, the pipe is introduced into the neutralizing tank 3 within which acid erosion or etching is completely prevented by means of a neutralizing solution. The pipe 10 which has passed through the neutralizing tank 3 is then placed in a suitable water rinsing tank, not shown, and in this manner, the pipes are continuously but sequentially subjected to the respective steps of an etching process performed upon their outer surfaces. In this case, the solutions supplied into the respective tanks will flow out through interstices defined between the pipe and the openings 18*f*, 18*r*, 19*f*, 19*r*, 20*f*, and 20*r*, however, the solutions are received within solution receiving means 1', 2', and 3' and then returned to the respective reservoirs T1, T2, and T3 so that the respective solutions will not be mixed with each other nor spilled outside of the tanks to be mixed with or diluted by means of the water from the water rinsing apparatus, either before, after, or between the respective process steps.

As has been described earlier, the time periods during which the pipe passes through the respective tanks 1, 2, and 3 are different, and difficulties may be encountered when varying the feeding speed of the pipe within each tank if the lengths of the tanks are maintained identical. In accordance with the present invention, therefore, the lengths of the tanks 1, 2, and 3 are varied in such a manner that the length of a particular tank is governed by the factors of the time during which the pipe is dipped within the tank and the feeding speed of the pipe 10 therewithin.

A second embodiment of the apparatus of the present invention will now be described in more detail by referring to FIGS. 7 and 8, within which a further improved etching effect may be achieved. Within FIGS. 7 and 8, there is shown two triple walled cylindrical bodies 30, each of which consists of an outer cylinder 25, an intermediate cylinder 26, and an inner cylinder 27. The respective cylinders 25, 26, and 27 are disposed coaxially with respect to the common axis of the through-holes or openings 18*f*, 18*r*, 19*f*, 19*r*, 20*f* and 20*r*, a pair of which are disposed in an opposing relation with respect to each other. A solution chamber 32 is defined between the outer cylinder 25 and the intermediate cylinder 26, and a solution is supplied under pressure through means of a main supply pipe 24 and branched conduits or pipes 28 and 29 which lead into the solution chambers 32, respectively, after which the solution flows through a communicating hole or port 26*a* defined within the wall of the intermediate cylinder 26 and into a solution passage 33 defined by means of the intermediate cylinder 26 therein. Subsequently, the solution flows at a uniform velocity with respect to the circumferential direction of the cylinder 26, and ultimately in the direction shown by means of the arrows, that is, in the axial direction of travel of the pipe 10.

In this respect, it is noted that the inner cylinder extends axially rearwardly beyond the communicating hole or port 26*a*, whereby the solution introduced through the communicating port 26*a* and into the solution passage 33 will not cause turbulence but in fact will present a rectified flow. Thus, the solution flows in the direction of travel of the pipe from the front opening 18*f* (19*f*, 20*f*) toward the rear opening 18*r* (19*r*, 20*r*), and the amount of the solution which flows in the reverse direction, as shown by means of the dotted-line arrow B, corresponds to approximately 10% of the solution supplied. The inside diameter of the inner cylinder should be at most 1.4 times as that of the pipe so as to reduce the amount of the solution which undergoes reverse flow, and the cross-sectional areas of the solution chamber 32, the communicating port 26*a*, and the solution passage 33 are so designed as not to cause a pressure drop when the solution is being introduced therethrough. Due to the pressure difference between the pressure prevailing within the solution chamber 32 and that within the solution passage 33, approximately 90% of the treating solution flows in the direction of the arrows shown by the solid lines, that is, in the direction of travel of the pipe, in such a manner as to provide a uniform flow around the circumferential surface of the pipe 10.

The embodiments of the present invention will now be described in greater detail by referring to FIGS. 3–11. Within FIGS. 3 and 4 there is shown the outline of the first embodiment of the apparatus according to the present invention, wherein the weak acid tank 1, concentrated acid tank 2, and neutralizing tank 3 are arranged in series, with the openings 18*f*, 18*r*, 19*f*, 19*r*, 20*f* and 20*r* disposed in alignment with each other. In addition, suitable sets of scrolls or rollers 4 and pinch rolls 5 for a guiding purpose to be described hereinafter, are provided and under these conditions two pipes 10 may be processed under the same conditions at the same time. As has been described herein earlier, in case the dipping duration periods within the respective tanks are to be different, the length of the tanks 1, 2, and 3 should each be determined depending upon the factors of the respective dipping periods of duration within a tank and the feeding speed of the pipe 10 therethrough, whereby the pipe which is rotatably conveyed through the tanks may be subjected to dipping therein for the desired duration periods, respectively. In the instance that the dipping duration periods within the respective tanks are to be the same, the lengths of the respective tanks may be the same.

As has been referred to herein earlier, solution supply pipes 7, having valves 6 disposed therein, are provided for the respective tanks 1, 2, and 3, while water-rinsing showers 8 are provided therebetween. With reference to FIGS. 5 and 6, the detailed constructions of the tanks 1, 2, and 3, are shown, the respective tanks 1, 2, and 3 being provided with openings 18, 19, or 20 within their front and rear walls, respectively, while liquid-receiving means 1', 2', or 3' are provided immediately below the openings 18*f*, 18*r*, 19*f*, 19*r*, and 20*f*, 20*r*, the same extending axially beyond the tanks 1, 2, and 3 forwardly and rearwardly thereof. A guide wall 34, for the solution being introduced therein, and a supporting guide 35, for the pipes 10, are provided within the tanks, while a splash-preventive cover 26 is provided upon the top portion of each of the tanks 1, 2, and 3, as seen within FIG. 6.

Figure 7:
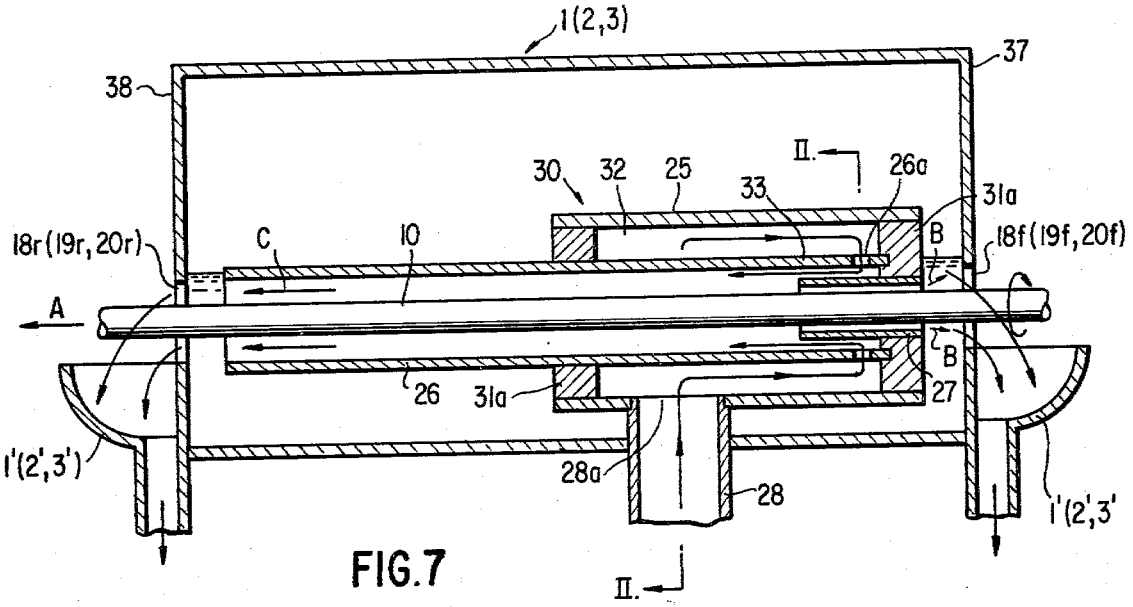
FIG. 7 is a longitudinal cross-sectional view of the essential parts of the apparatus having a triple-walled cylindrical body in accordance with the present invention.
Figure 8:
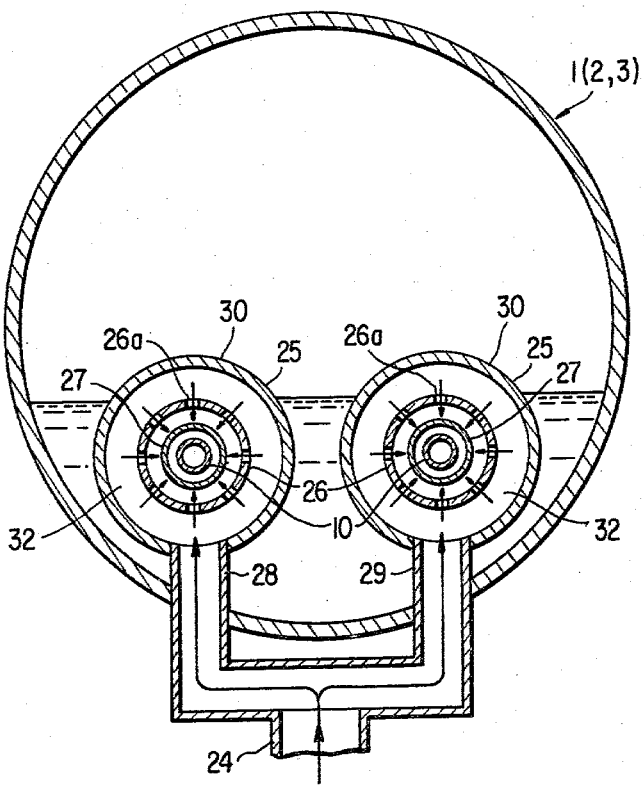
FIG. 8 is a cross-sectional view of the apparatus of FIG. 7 taken along the line II—II of FIG. 7.

The second embodiment of the apparatus of the present invention is shown within FIGS. 7 and 8 within which there is provided a triple-walled cylindrical body within each of the tanks. The triple-walled cylindrical body 30 consists of an outer cylinder 25, an intermediate cylinder 26, and an inner cylinder 27, and the respective cylinders are arranged in coaxial fashion, the openings 18*f*, 18*r*, 19*f*, 19*r*, 20*f*, and 20*r* being defined within the opposing, front and rear walls of the tank 1, 2, or 3. As shown within FIG. 7, the intermediate cylinder 26 has a considerable length and a plurality of communicating holes or ports 26*a* defined within the front end portion thereof, which ports are disposed circumferentially thereabout with a predetermined spacing therebetween.

The outer cylinder encompasses the front end portion of the intermediate cylinder 26, and annular plug members 31*a* are fitted within the spaces defined between the outer cylinder 25 and the intermediate cylinder 26 or the inner cylinder 27, at the front and rear ends of body 30. A solution chamber 32 is defined between cylinders 25 and 26, and the inner cylinder 27 is supported by means of the plug member 31*a* so as to axially extend beyond the communicating ports 26*a* in both directions thereof, whereby a solution passage 33 is defined between the inner cylinder 27 and the intermediate cylinder 26, the solution chamber 32 being in communication with the solution passage 33 by means of ports 26*a*. Solution supply ports or openings 28*a* are defined within the wall of the outer cylinder 25 for introducing a solution into the solution chamber 32, and branched pipes 28 and 29 of the solution supply pipe 24 are in communication with the aforenoted solution supply openings 28*a*. In this manner, it is recommended that the positions of the solution supply openings 28*a* be in the rear end portions of the outer cylinders 25 in order to equalize the pressure within the solution chamber 32.

Figure 9:
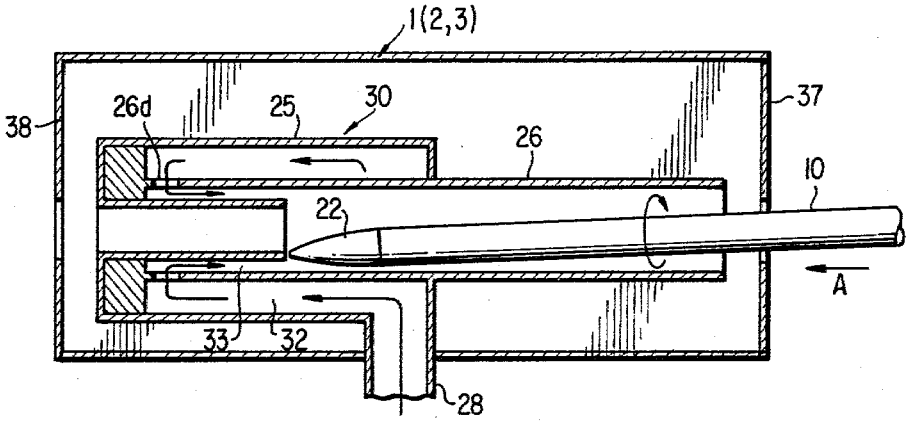
FIG. 9 is a schematic view, partly in cross-section, of an apparatus wherein the pipe to be treated travels in the direction opposite to that of the pipe within the previous embodiment of the present invention.

In the instance that the tripled-walled cylindrical body 30 is provided within the rear portion of the tank, as shown within FIG. 9, there results a flow of solution in the direction opposite that of the travel direction of the pipe 10, and consequently the velocity of the solution relative to the pipe 10, may be increased. However, if the pipe 10 is eccentric, even to a slight degree, the pipe 10 will undergo a swinging or displacement motion due to the pressure of the solution within the solution passage 33, and the tip of the pipe may impinge upon the end face wall of the inner cylinder 27. In addition, as there is provided no guide means extending from the side wall of the tank at the front side thereof, to the inner cylinder 27, the pipes 10 are apt to experience damage to their surfaces.

Figure 10:
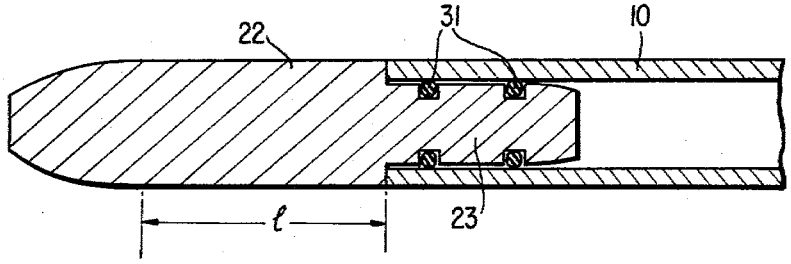
FIG. 10 is a longitudinal cross sectional view of a plug fitted within a pipe to be treated.
Figure 11A:
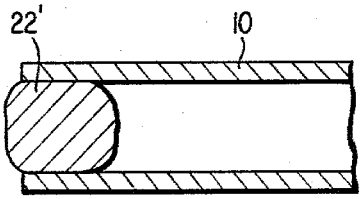
FIGS. 11*a* and 11*b* are partial cross-sectional views showing a different embodiment of a plug, and the resulting defect which occurs at the open-end portion of the pipe, respectively.
Figure 11B:
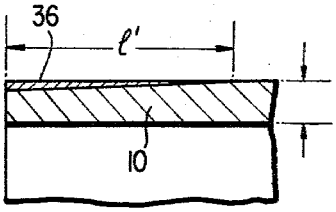

As has been described earlier, plugs or caps 22 should be provided within the open end of the pipes 10 for preventing the ingress of solution therein, and it is preferable in this respect that the configuration of the plug 22 be such as that shown within FIG. 10 when providing etching for the outer surface of the pipe. The outside diameter of the plug 22 is the same as that of the pipe 10 so as to provide a joint having a flush surface therebetween, and in addition, the plug 22 has O-rings 31 within its rear end portion 23 which is to be sealingly fittted within the open end of the pipe. Still further, the constant diameter length portion l of the plug should be at least 70 mm, as measured from the open end of the pipe 10, and yet further, the plug 22 should have a forward tapered head portion, so that there results a smooth flow along the outer surface of the plug 22. Stated otherwise, if the plug 22' as shown within FIG. 11 is utilized then there results turbulence around the head portion of the plug 22' resulting in the tapered portion 36 of the outer surface of the pipe due to the excessive etching action of the acid acting thereon, the aforenoted tapered portion extending approximately 70 mm, as measured from the open end of the pipe 10.

The etching process and apparatus according to the present invention, which are applied to the outer surface of a metal member, such as, for example, a bar, rod, pipe or tube is excellent in efficiency due to the continuous, automated operation thereof. According to the present invention, the respective tanks are arranged in series upon a platform or base, and the respective tanks have through-holes or openings within their front and rear walls, with the aforenoted openings arranged in alignment with each other, whereby one or more pipes may be rotatably conveyed through the respective tanks in an automatic continuous manner which of course facilitates the continuous steps of the etching process to be performed. This could not have been achieved according to the prior art dipping etching process.

According to the present invention, the number of rods or pipes to be conveyed through the tanks may be increased, when arranged in parallel, thus allowing the etching process for a plurality of pipes under the same condition as that performed with sequentially disposed pipes, if the desired size of tanks and the feeding capability of the solution is correspondingly accomplished. In addition, the pipe, tube rod or bar being conveyed is rotated, so that in case hydrogen gas is generated from the undersurface of the pipe, the hydrogen gas may rise upwardly along the circumferential surface of the pipe, thus preventing pits and local errosion upon the surface thereof. The treating solutions within the respective tanks are pressurized, however, the same flow uniformly along the outer surfaace of the pipe, tube rod or bar in the direction of travel thereof, so that there may be obtained a smooth and uniform mirror surface upon the pipe, tube rod or bar. Yet further, such prevents the occurrence of microspots, and readily insures the control of the product dimensions, that is, control in the reduction of the diameter of the pipe due to the etching thereof by means of the acid, as well as local excessive etching, such as for example, upon the surface of the open ends of the pipe.

Still yet further, the apparatus according to the present invention facilitates an etching treatment for pipes, irrespective of their lengths, so that there is no longer a need to provide pipes of a given length nor the provision of a plurality of supporting bases, supporting members, cases, cranes, or the like. In contrast thereto, all that is required for the etching process for a pipe of the present invention, is to fit plugs within the open ends of the pipe and to then place the pipes upon the rollers. This substantially improves the operational efficiency of the etching process. In addition, the sizes of the tanks may be rendered compact and the treating solutions may be effectively utilized, so that the amount of treating solution may be conserved, the amount being used being in fact approximately ½-5/6 the amount of solutions as used within the prior art apparatus.

The process and apparatus according to the present invention may also be applied to the etching of pipe made of, for example, zirconium or zirconium alloy wherein there is required surface conditions of precise characteristics which of course normally requires many man-hours because of such strict control and monitoring of the treating conditions. Furthermore, there is no possibility of various kinds of treating solutions being mixed with each other within the apparatus of the present invention, and the apparatus is well adapted for use in mirror-surface finishing of pipes, or the removal of defects from the surfaces thereof, as well as etching of metal members, such as for example, a bar, rod, pipe or tube, for surface-working or repair operations. The apparatus according to the present invention thus provides further improved operational efficiency and safe working conditions, as compared with those of the prior art dipping processes.

It should also be noted that tests, by means of a microscope or a piezoelectric styrus-type roughness meter, reveal that pipe, made of for example, zirconium alloy and subjected to the etching process according to the present invention, is superior in its surface condition to that of pipe subjected to prior art etching processes, such as that shown within FIG. 1, and it is to be additionally noted as noted heretofore, that in the case of etching a member which is not made of a specialized metal, such as for example, zirconium or zirconium alloy, several tanks and solutions may not be required, and in fact only a single tank containing a single treating solution for performance of a single etching step or process may be required.

Obviously, many modifications and variations of the present invention are possible in light of the above teachings. It is to be understood therefore that within the scope of the appended claims, the invention may be practiced otherwise than as specifically described herein.

What is claimed as new and desired to be secured by Letters Patent of the United States is:

1. An etching process for use in chemically etching the outer surface of a metal member in a plurality of tanks including inlet and outlet openings in the front and rear opposed walls thereof, comprising the steps of:

positioning said plurality of tanks in series and aligning said inlet and outlet openings of said tanks, respectively;

disposing an etching treating solution within each of said plurality of tanks;

feeding said metal member though said inlet and outlet openings of said tanks and through said tanks in a direction parallel to the longitudinal axis of said member while rotating the same about said longitudinal axis thereof;

immersing said metal member in said etching treating solution within each of said plurality of tanks;

forceably conducting etching treating solution in the axial direction of feeding of said metal member within each of said tanks; and independently feeding said metal member through said inlet and outlet openings and through said tanks in a continuous and sequential manner while rotating said metal member.

2. An etching process for use in chemically etching the outer surface of a metal member in a plurality of tanks including inlet and outlet openings in the front and rear opposed walls thereof, comprising the steps of:

positioning said plurality of tanks in series and aligning said inlet and outlet openings of said tanks, respectively;

disposing an etching treating solution within each of said plurality of tanks;

feeding said metal member through said inlet and outlet openings of said tanks and through said tanks in a direction parallel to the longitudinal axis of said member while rotating the same about said longitudinal axis thereof;

forceably conducting etching treating solution in a travelling direction opposite that of said metal member being fed within said tanks; and feeding said metal member through said inlet and outlet openings and through said tanks in a continuous and sequential manner while rotating said metal member.

3. An etching process as set forth in claim 1, wherein said step of disposing an etching treating solution within each of said plurality of tanks includes;

disposing a first acid in a first tank; and disposing a second acid relatively more concentrated than the first acid in a second tank so as to provide varying degrees of etching to the outer surface of said metal member.

4. An etching process as defined within claim 1, wherein said process further comprises the steps of:

water-rinsing said metal member, so as to remove said etching treating solution which may adhere to the surface of said metal member, between adjoining tanks.

5. An etching process as defined within claim 1, which further comprises:

maintaining the levels of said etching treating solutions in said plurality of tanks in such a manner that said etching treating solutions cover the entire length of said metal member.

6. An etching process as defined within claim 1, wherein:

receiving and returning etching treating solution overflowing through the interstices defined between the wall of said tank defining said inlet and outlet openings and said metal member to a corresponding one of said tanks.

* * * * *